US005079134A

United States Patent [19]

Toya

[11] Patent Number: 5,079,134

[45] Date of Patent: Jan. 7, 1992

[54] X-RAY PHOTOGRAPHIC MATERIAL

[75] Inventor: Ichizo Toya, Kanagawa, Japan

[73] Assignee: Fuji Photo Film Co., Ltd., Kanagawa, Japan

[21] Appl. No.: 531,426

[22] Filed: May 31, 1990

[30] Foreign Application Priority Data

Jun. 1, 1989 [JP] Japan ..... 1-139691

[51] Int. Cl.[5] ..... G03C 5/24

[52] U.S. Cl. ..... 430/434; 430/139; 430/502; 430/510; 430/522; 430/966

[58] Field of Search ..... 430/522, 504, 139, 966, 430/434, 510, 502

[56] References Cited

U.S. PATENT DOCUMENTS

| | | | |
|---|---|---|---|
| 2,527,583 | 10/1950 | Silberstein et al. | 430/507 |
| 4,092,168 | 5/1978 | Lemahieu et al. | 430/510 |
| 4,130,429 | 12/1978 | Van Doorselaer | 430/139 |
| 4,500,631 | 2/1985 | Sakamoto et al. | 430/522 |
| 4,574,115 | 3/1986 | Adachi et al. | 430/522 |
| 4,751,174 | 6/1988 | Toya | 430/502 |
| 4,857,446 | 8/1989 | Diehl et al. | 430/522 |
| 4,861,702 | 8/1989 | Suzuki et al. | 430/966 |
| 4,900,652 | 2/1990 | Dickerson et al. | 430/966 |
| 4,988,611 | 1/1991 | Anderson et al. | 430/522 |

*Primary Examiner*—Richard L. Schilling
*Assistant Examiner*—Thomas R. Neville
*Attorney, Agent, or Firm*—Sughrue, Mion, Zinn, Macpeak & Seas

[57] ABSTRACT

An X-ray photographic material which exhibits reduced crossover and exhibits no objectionable after-color (stain) upon rapid processing, comprising a transparent support having at least one photosensitive silver halide emulsion layer provided on each side of said support and having at least one layer containing a dye which absorbs light in the sensitive region of said sensitive silver halide photographic emulsion layer provided between said light-sensitive emulsion layer and the support, wherein crossover is less than 10%, said dye is adsorbed onto fine particles which fine particles provide surfaces onto which the dye can be adsorbed, said dye can be decolorized or washed out during development, and said dye is a compound selected from the group consisting of compounds represented by the formulae set forth in the specification.

11 Claims, No Drawings

X-RAY PHOTOGRAPHIC MATERIAL

FIELD OF THE INVENTION

This invention relates to an X-ray silver halide photographic material. More particularly, it relates to a photographic material which gives an image having improved image quality (particularly sharpness) in medical image forming methods (particularly methods using X-rays) using said photographic material, can cope with rapid processing and can be stably prepared (i,e., wherein the emulsion does not undergo surface damage caused by agglomerates, and wherein the dyes can be dispersed without much labor or filter exchange to remove agglomerates).

BACKGROUND OF THE INVENTION

It has been demanded to provide photographic materials which give images having high sharpness to make correct diagnoses and which can be rapidly processed (in a short time of shorter than 90 seconds) to make urgent diagnosis in the field of medical photographic materials in recent years.

With regard to sharpness, there have been proposed methods wherein an improvement in sharpness depends on the rate of light absorbed onto spectral sensitizing dyes which in large quantities are adsorbed onto silver halide grains having a large specific surface area and a high aspect ratio (ratio of the average diameter of circles corresponding to the projected areas of grains to the thickness of the grains) in an ortho-system (a system consisting of a combination of a rare earth element intensifying screen such as typically $Gd_2O_2S$ with an ortho-photographic material having sensitivity in the green region). JP-A-1-126646 discloses a method for improving sharpness wherein there are used photographic materials containing dyes absorbing light in the sensitive region thereof, said dyes being deposited on mordants.

However, when high sharpness (crossover of less than 10%) is attained in these methods, there is caused a problem of residual color in rapid processing in a short period of shorter than 90 seconds.

A method wherein crossover is made less than 10% by using dyes in the form of crystallite grains has been recently disclosed in European Patent Laid-Open No. 276566A. The problems of sharpness and remaining color in 90-second processing can be solved by this method. However, a problem of residual color in 45-second processing is caused. When dyes are allowed to exist in the form of crystallite grains in 45-second processing, the amounts of binders must be increased. That is, when the amounts of the binders are reduced, surface damage is caused and the correctness of diagnoses is greatly reduced. On the other hand, when the amounts of the binder are increased, the possibility of forming agglomerates is increased and surface damage is liable to be caused. Methods for removing agglomerates with filters have been proposed to solve the problem. However, these methods have a serious problem in the handling of the photographic materials during the course of production.

Accordingly, it has been demanded to provide a method wherein dyes are allowed to exist in dye-fixing layers of X-ray films without forming crystallite or agglomerates.

SUMMARY OF THE INVENTION

An object of the present invention is to provide a medical photographic material which can be stably prepared, give an image having greatly improved sharpness and can be rapidly processed.

The above-described object of the present invention has been achieved by providing an X-ray photographic material comprising a transparent support having at least one photosensitive silver halide emulsion layer provided on each side of said support and having at least one layer containing a dye which absorbs light in the sensitive region of said sensitive silver halide photographic emulsion layer provided between said light-sensitive emulsion layers, wherein:

(a) crossover is less than 10%;

(b) said dye is adsorbed onto fine particles which fine particles provide surfaces onto which the dye can be adsorbed;

(c) said dye can be decolorized or washed out during development; and (d) said dye is a compound selected from the group consisting of compounds represented by the following formulae (I) to (V)

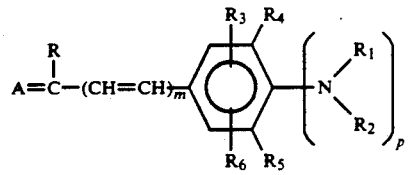

(I)

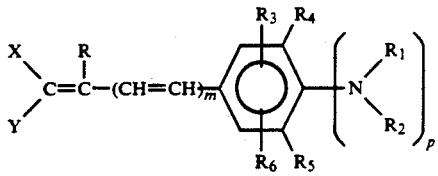

(II)

$$A{=}L_1{\rightarrow}L_2{=}L_3{\rightarrow}_n A' \quad \text{(III)}$$

$$A{\rightarrow}L_1{-}L_2{\rightarrow}_{2-m} B \quad \text{(IV)}$$

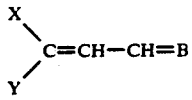

(V)

wherein A and A' may be the same or different groups and each represents a substituted or unsubstituted acid nucleus having a carboxyphenyl group, a sulfamoylphenyl group, a sulfonamidophenyl group, a carboxyalkyl group or hydroxyphenyl group, said acid nucleus being selected from the group consisting of 2-pyrazoline-5-one, rhodanine, hydantoin, thiohydantoin, 2,4-oxazolidinedione, isoxazolidinone, barbituric acid, thiobarbituric acid, indanedione, pyrazolopyridine and hydroxypyridone; B represents a substituted or unsubstituted basic nucleus having carboxyl group, sulfamoyl group or sulfonamido group, said basic nucleus being selected from the group consisting of pyridine, quinoline, indolenine, oxazole, benzoxazole, naphthoxazole and pyrrole; R represents hydrogen atom or an alkyl group; $R_1$ and $R_2$ each represents a substituted or unsubstituted alkyl group, a substituted or unsubstituted aryl group, an acyl group or a sulfonyl group, or $R_1$ and $R_2$ may be combined together to form a 5-membered or 6-membered ring; $R_3$ and $R_6$ each represents a hydrogen atom, a hydroxyl group, a carboxyl group, an alkyl group, an alkoxy group or a halogen atom; $R_4$ and $R_5$ each represents a hydrogen atom or a non-metallic atomic group required for the formation of a 5-membered or 6-membered ring when $R_1$ and $R_4$ or $R_2$ and $R_5$ are combined together; $L_1$, $L_2$ and $L_3$ each represents a substituted or unsubstituted methine group; X and Y each represents an electron attractive group and one of X and Y has at least one carboxyphenyl, sulfamoylphenyl, sulfonamidophenyl, carboxyalkyl or hydroxyphenyl group; m represents 0 or 1; n represents 0, 1 or 2; and p represents 0 or 1 with the proviso that when p is 0, $R_3$ is a hydroxy group or a carboxyl group and $R_4$ and $R_5$ each is a hydrogen atom.

DETAILED DESCRIPTION OF THE INVENTION

The term "fine particles providing surfaces on which the dye can be adsorbed" as used herein means that fine particles form a discontinuous solid phase different from the hydrophilic colloid (hereinafter referred to as binder) continuous phase and are mixed with and dispersed in the binder.

Hydrophilicity may be imparted to the surfaces of the fine particles (surfaces to be brought into contact with the binder) to facilitate mixing dispersion. Methods for imparting hydrophilicity is preferably a method wherein a hydrophilic moiety is introduced into the chemical structural composition of the particle surface or a method using particles whose surfaces are treated with a surfactant to provide a micellar layer. Alternatively, these methods are used in combination.

Examples of the chemical structure of the composition having a hydrophilic moiety include compositions having at least one Lewis acid element such as oxygen element, sulfur element, halogen element or the like. Compositions having an atomic group such as a carboxyl group, hydroxyl group, sulfo group or phosphoric acid group are particularly preferred.

Examples of the surfactant for use as a dispersion aid for the particle in treating the surface of the particle with the micellar layer by the surfactant include anionic surfactants such as alkylbenzenesulfonates, alkylnaphthalene sulfonates, alkylsulfonates, alkylsulfuric esters, alkylphosphoric esters, sulfosuccinic esters and sulfoalkylpolyoxyethylene alkylphenyl ethers; nonionic surfactants such as the steroid saponin, alkylene oxide derivatives and glycidol derivatives; amphoteric surfactants such as amino acids, aminoalkylsulfonic acids and alkylbetaines; and cationic surfactants such as quaternary ammonium salts. Specific examples of these surfactants are described in *KAIMEN KASSEI-ZAI BENRAN* (Surfactant Handbook) (1966, published by Sangyo Tosho) and *NYUKA-ZAI.NYUKA-SOCHI.-GIJUTSU DATA SHU* (Technical Data of Research for Emulsion and Emulsifier) (1978, published by Kagaku Hanron Sha).

Further, there are cases where compounds such as polyvinyl alcohol derivatives, gelatin or cellulose derivatives which themselves serve as binders, function as surfactants.

The chemical composition of fine particles which are used in the present invention may be composed of a single substance or a mixture of two or more compounds. Alternatively, the chemical composition in the interior or exterior part of one particle or on the surface part thereof may be uniform, or the interior, exterior or surface part thereof may be composed of a mixture having two or more chemical compositions.

Examples of compounds which constitute the fine particles of the present invention include, but are not limited to, the following materials.

First, examples of minerals include materials shown in Table 1.

TABLE 1

| | | |
|---|---|---|
| Talc | Bismuthinite | Calcite |
| Kaolin | Kainite | Enargite |
| Graphite | Sylvite | Olivenite |
| Molybdenite | Muscovite | Anhydrite |
| Hematite | Cinnabar | Celestite |
| Covellite | Pyrolusite | Millerite |
| Niter | Polybasite | Chalcopyrite |
| Soda niter | Brucite | Spharlerite |
| Orpiment | Borax | Barite |
| Realgar | Carnallite | Dolomite |
| Vivianite | Cryolite | Heulandite |
| Sulfur | Phlogopite | Magnesite |
| Gypsum | Bournonite | Fluorite |
| Stibnite | Crocoite | Pyrrhotite |
| Zinccite | Cobaltite | Quensilite |
| Smithsonite | Uraninite | Quartz |
| Colemanite | Psilomelane | Garnet |
| Phillipsite | Smaltite | Agate |
| Wollastonite | Anatase | Beryl |
| Scheelite | Sodalite | Tourmaline |
| Hemimorphite | Orthoclase | Staurolite |
| Apophyllite | Magnetite | Andalusite |
| Thorite | Plagioclase | Zircon |
| Apatite | Rutile | Spinel |
| Wolframite | Pyrite | Topaz |
| Limonite | Prehnite | Phenacite |
| Niccolite | Spodumene | Chrysoberyl |
| Arsenopyrite | Cassiterite | Corundum |
| Willemite | Diaspore | Carborundum |
| Chromite | Olivine | Diamond |

Further examples of fine particles include metals such as Au, Ag, Cu, Zn, Ti, Sn, In, Mo, W,Fe, Al, Si, Co, Zr, Ni, Pd, Cd, Ru, Rh, and Ir and oxides of these metals.

Examples of fine particles which are easily commercially available include colloidal silica, colloidal alumina and a mixture thereof. More specifically, these materials are commercially available under tradenames of Ludox AM, Ludox AS, Ludox LS, Ludox TM and Ludox HS (products of E.I. Du Pont De Nemours Co., U.S.A.), Snowtex 20, Snowtex C, Snowtex N and Snowtex 0 (products of Nissan Kagaku K.K.), Syton C-30 and Syton 200 (products of Monsanto Co., U.S.A.) and Nalcoag 1030, Nalcoag 1060 and Nalcoag ID 21-64 (products of Nalco Chem. Co., U.S.A.).

The fine particles which are used in the present invention may contain inorganic bases such as sodium hydroxide, potassium hydroxide, lithium hydroxide, ammonium hydroxide, sodium carbonate and potassium carbonate and organic bases such as tetramethylammonium ion as stabilizers. With regard to stability, higher pH and lower ion intensity are preferable. Accordingly, sodium hydroxide, potassium hydroxide and ammonium hydroxide are particularly preferred as stabilizers.

Particularly preferred fine particles which are used in the present invention are colloidal silica, colloidal alumina and colloidal silica alumina.

If desired, silver halide crystals may be used as fine particles.

The size of the fine particles of the present invention (the diameter of a sphere having the same volume) is not larger than 2 μm, but not smaller than 0.001 μm, preferably not larger than 1 μm, but not smaller than 0.005 μm, particularly preferably not larger than 0.5 μm, but not smaller than 0.005 μm. The fine particles are used in an amount of 10 mg/m² to 10 g/m², preferably 50 mg/m² to 1 g/m².

The fine particles of the present invention can be mixed with the dyes in the following manner. The dye is previously dissolved in an alkali to prepare an aqueous dye solution. The dye solution is mixed with an aqueous dispersion of the fine particles. The pH of the mixture is adjusted to a desired value (e.g., pH in the range of 4 to 8). The mixture is then added to an aqueous solution of a binder (e.g., gelatin) to prepare a coating solution. Alternatively, the mixture of the dye solution and the dispersion is mixed with the aqueous binder solution, and the pH value of the resulting mixture is then adjusted to a desired value.

Compounds selected from the group consisting of compounds represented by the following formulas (I) to (V) can be used as the dyes of the present invention. These compounds may be used either alone or in a combination of two or more of them.

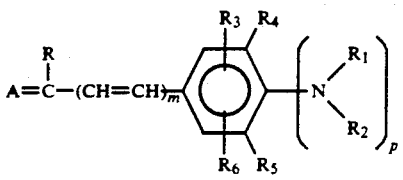
(I)

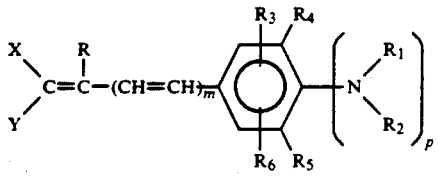
(II)

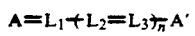
(III)

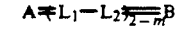
(IV)

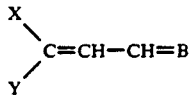
(V)

In the above formulas, A and A' may be the same or different groups and each represents a substituted or unsubstituted acid nucleus having a carboxyphenyl group, a sulfamoylphenyl group, a sulfonamidophenyl group, a carboxyalkyl group or a hydroxyphenyl group, said acid nucleus being selected from the group consisting of 2-pyrazoline-5-one, rhodanine, hydantoin, thiohydantoin, 2,4-oxazolidinedione, isoxazolidinone, barbituric acid, thiobarbituric acid, indanedione, pyrazolopyridine and hydroxypyridone; B represents a substituted or unsubstituted basic nucleus having a carboxyl group, sulfamoyl group or sulfonamido group, said basic nucleus being selected from the group consisting of pyridine, quinoline, indolenine, oxazole, benzoxazole, naphthoxazole and pyrrole; R represents a hydrogen atom or an alkyl group, $R_1$ and $R_2$ each represents a substituted or unsubstituted alkyl group, a substituted or unsubstituted aryl group, an acyl group or a sulfonyl group, or $R_1$ and $R_2$ may be combined together to form a 5-membered or 6-membered ring; $R_3$ and $R_6$ each represents a hydrogen atom, hydroxyl group, carboxyl group, an alkyl group, an alkoxy group or a halogen atom; $R_4$ and $R_5$ each represents a hydrogen atom or a non-metallic atomic group required for the formation of a 5-membered or 6-membered ring when $R_1$ and $R_4$ or $R_2$ and $R_5$ are combined together; $L_1$, $L_2$ and $L_3$ each represents a substituted or unsubstituted methine group; X and Y each represents an an electron attractive group and one of X and Y is an electron attractive group having at least one carboxyphenyl group, sulfamoylphenyl group, sulfonamidophenyl group, carboxyalkyl group or hydroxyphenyl group; m represents 0 or 1; n represents 0, 1 or 2; and p represents 0 or 1 with the proviso that when p is 0, $R_3$ is a hydroxy group or carboxyl group and $R_4$ and $R_5$ are hydrogen atoms.

Each group in formulae (I), (II), (III), (IV) and (V) of the present invention will be illustrated in more detail below.

The carboxyphenyl group attached to the acid nuclei represented by A and A' and the electron attractive groups represented by X and Y include a phenyl group having only one carboxy group as well as a phenyl group having two or three carboxy groups. Similarly, each of sulfamoylphenyl, sulfonamidophenyl and hydroxyphenyl groups include a phenyl group having not only one sulfamoyl group, sulfonamido group or hydroxy group but also two or three sulfamoyl, sulfonamido or hydroxy groups or mixtures thereof. In addition to carboxy group, sulfamoyl group, sulfonamido group and hydroxy group, the phenyl group may have other substituent groups without particular limitation, so long as said substituent groups are dissociative substituent groups having a pKa (dissociation constant) of not lower than 4 in a solution of water and ethanol (1:1 by volume) or non-dissociative substituent groups. Examples of the phenyl groups include 4-carboxyphenyl, 3,5-dicarboxyphenyl, 2,4-dicarboxyphenyl, 3-carboxyphenyl, 2-methyl-3-carboxyphenyl, 3-ethylsulfamoylphenyl, 4-phenylsulfamoylphenyl, 2-caboxyphenyl, 2,5-dicarboxyphenyl, 2,4,6-trihydroxyphenyl, 3-benzenesulfonamidophenyl, 4-(p-cyanobenzenesulfonamido)phenyl, 3-hydroxyphenyl, 2-hydroxyphenyl, 4-hydroxyphenyl, 2,4-dihydroxyphenyl, 3,4,5-trihydroxyphenyl, 2-hydroxy-4-carboxyphenyl, 3-methoxy-4-carboxyphenyl and 2-methyl-4-phenylsulfamoylphenyl groups. These groups may be attached to the acid nuclei directly or through methylene group, ethylene group or propylene group.

The carboxyalkyl group attached to the acid nuclei represented by A and A' and the electron attractive group represented by X or Y preferably has from 1 to 10 carbon atoms. Examples of the carboxyalkyl group include carboxymethyl, 2-carboxyethyl, 3-carboxypropyl, 2-carboxypropyl, 4-carboxybutyl and 8-carboxyoctyl.

The alkyl groups represented by R, $R_3$ and $R_6$ preferably have from 1 to 10 carbon atoms. Examples of the alkyl group include methyl, ethyl, n-propyl, isoamyl and n-octyl.

The alkyl groups represented by $R_1$ and $R_2$ preferably have from 1 to 20 carbon atoms. Examples of the alkyl group include methyl, ethyl, n-propyl, n-butyl, n-octyl, n-octadecyl, isobutyl and isopropyl. The alkyl group may be substituted. Examples of substituent groups include a halogen (e.g., chlorine, bromine), nitro group, cyano group, hydroxy group, carboxy group, an alkoxy group (e.g., methoxy, ethoxy), an alkoxycarbonyl group (e.g., methoxycarbonyl, i-propoxycarbonyl), an aryloxy group (e.g., phenoxy), a phenyl group, an amido group (e.g., acetylamino, methanesulfonamido), a carbamoyl group (e.g., methylcarbamoyl, ethylcarbamoyl) and a sulfamoyl group (e.g., methylsulfamoyl, phenylsulfamoyl).

The aryl group represented by $R_1$ and $R_2$ is preferably a phenyl group or naphthyl group, and may be substituted. Examples of substituent groups include those already described above in the definition of the substituent groups for the alkyl group represented by $R_1$ and $R_2$ and an alkyl group (e.g., methyl, ethyl).

The acyl group represented by $R_1$ and $R_2$ has preferably from 2 to 10 carbon atoms. Examples of the acyl group include acetyl, propionyl, n-octanoyl, n-decanoyl, isobutanoyl and benzoyl.

Examples of the alkyl- or arylsulfonyl group represented by $R_1$ and $R_2$ include methanesulfonyl, ethanesulfonyl, n-butanesulfonyl, n-octanesulfonyl, benzenesulfonyl, p-toluenesulfonyl and o-carboxybenzenesulfonyl.

The alkoxy group represented by $R_3$ and $R_6$ has preferably from 1 to 10 carbon atoms. Examples of the alkoxy group include methoxy, ethoxy, n-butoxy, n-octoxy, 2-ethylhexyloxy, isobutoxy and isopropoxy. Examples of halogen represented by $R_3$ and $R_6$ include chlorine, bromine and fluorine.

An example of the ring formed by combining $R_1$ and $R_4$ or $R_2$ and $R_5$ is julolidine ring.

Examples of the 5-membered or 6-membered ring formed by combining $R_1$ and $R_2$ together include piperidine ring, morpholine ring and pyrrolidine ring.

The methine group represented by $L_1$, $L_2$ and $L_3$ may have one or more Substituent groups (e.g., methyl, ethyl, cyano, phenyl, chlorine, hydroxypropyl).

The electron attractive groups represented by X and Y may be the same or different groups. Examples of the electron attractive groups cyano group, carboxy group, an alkylcarbonyl group (including a substituted alkylcarbonyl group; e.g., acetyl, propionyl, heptanoyl, dodecanoyl, hexadecanoyl, 1-oxo-7-chloroheptyl), an arylcarbonyl group (including a substituted arylcarbonyl group; e.g., benzoyl, 4-ethoxycarbonylbenzoyl, 3-chlorobenzoyl), an alkoxycarbonyl group (including a substituted alkoxycarbonyl group; e.g., methoxycarbonyl, ethoxycarbonyl, butoxycarbonyl, t-amyloxycarbonyl, hexyloxycarbonyl, 2-ethylhexyloxycarbonyl, octyloxycarbonyl, decyloxycarbonyl, dodecyloxycarbonyl, hexadecyloxycarbonyl, octadecyloxycarbonyl, 2-butoxyethoxycarbonyl, 2-methylsulfonylethoxycarbonyl, 2-cyanoethoxycarbonyl, 2-(2-chloroethoxy)ethoxycarbonyl, 2-[2-(2-chloroethoxy)ethoxy]ethoxycarbonyl), an aryloxycarbonyl group (including a substituted aryloxycarbonyl group; e.g., phenoxycarbonyl, 3-ethylphenoxycarbonyl, 4-ethylphenoxycarbonyl, 4-fluorophenoxycarbonyl, 4-nitrophenoxycarbonyl, 4-methoxyphenoxycarbonyl and 2,4-di-(t-amyl)phenoxycarbonyl), a carbamoyl group (including a substituted carbamoyl group; e.g., carbamoyl, ethylcarbamoyl, dodecylcarbamoyl, phenylcarbamoyl, 4-methoxyphenylcarbamoyl, 2-bromophenylcarbamoyl, 4-chlorophenylcarbamoyl, 4-ethoxycarbonylphenylcarbamoyl, 4-propylsulfonylphenylcarbamoyl, 4-cyanophenylcarbamoyl, 3-methylphenylcarbamoyl, 4-hexyloxyphenylcarbamoyl, 2,4-di-(t-amyl)phenylcarbamoyl, 2-chloro-3-(dodecyloxycarbonyl)phenylcarbamoyl, 3-(hexyloxycarbonyl)phenylcarbamoyl), a sulfonyl group (e.g., methylsulfonyl, phenylsulfonyl) and a sulfamoyl group (including a substituted sulfamoyl group; e.g., sulfamoyl, methylsulfamoyl).

Examples of the dyes which are used in the present invention include, but are not limited to, the following compounds.

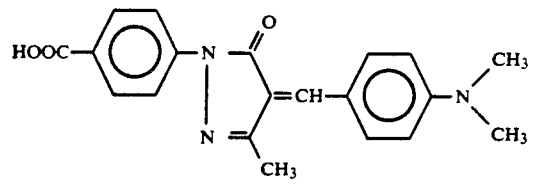

I-1

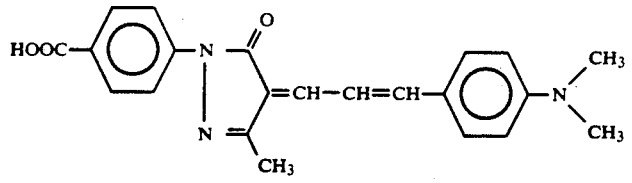

I-2

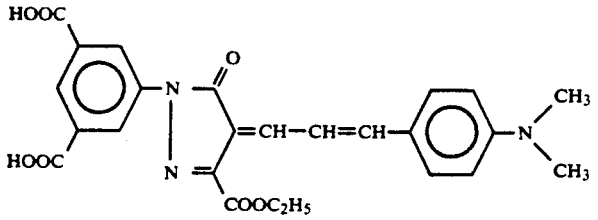

I-3

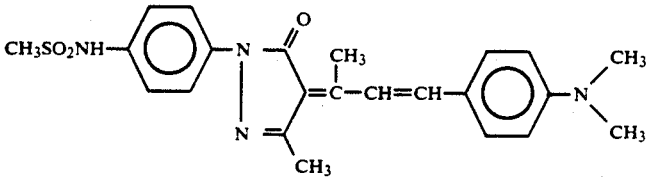

I-4

-continued
I-5
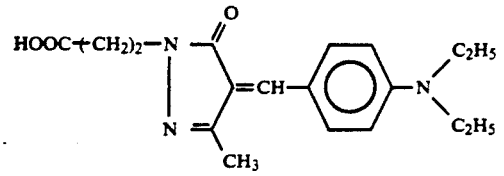
I-6
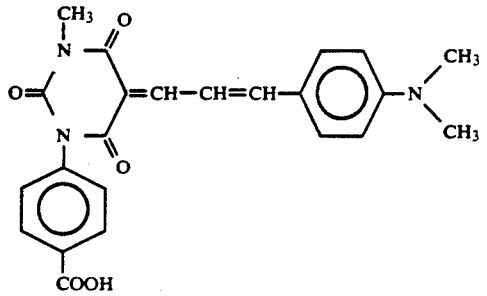
I-7
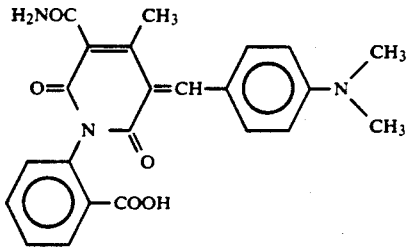
I-8
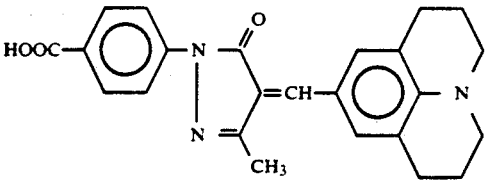
I-10
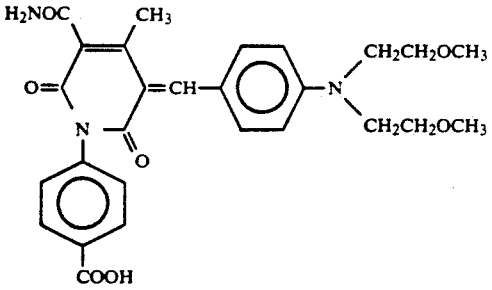
I-11
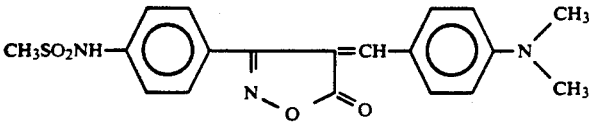
I-12
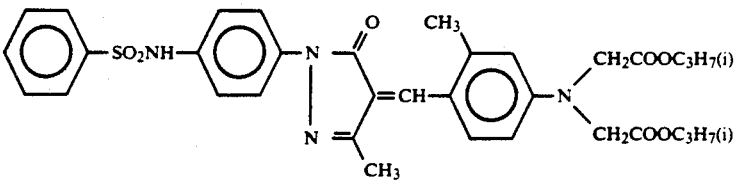

-continued
I-13
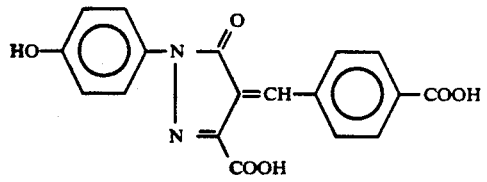
I-14
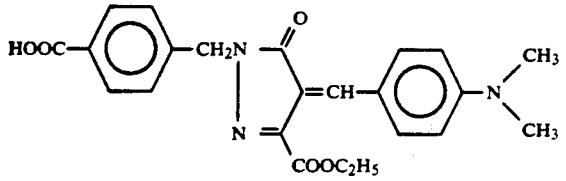
I-15
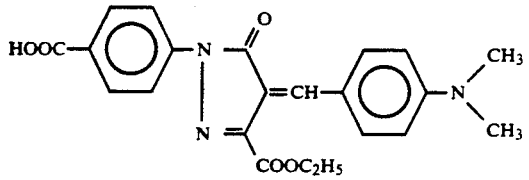
I-16
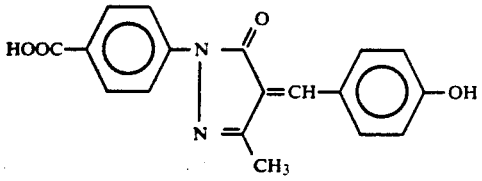
I-17
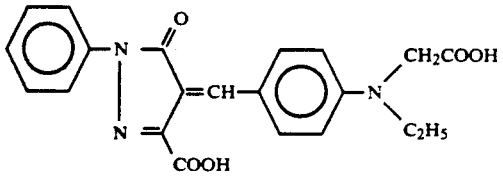
II-1
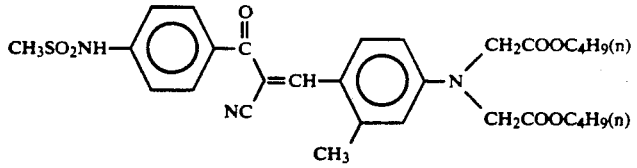
II-2
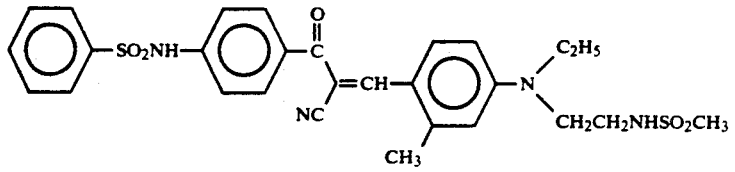
II-3
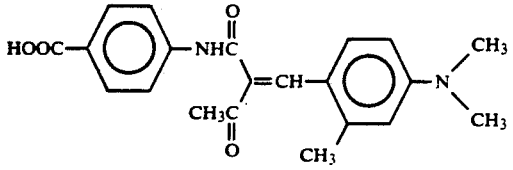

-continued
III-1
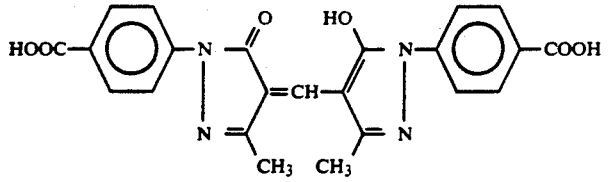
III-2
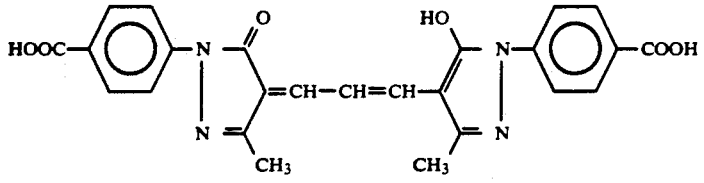
III-3
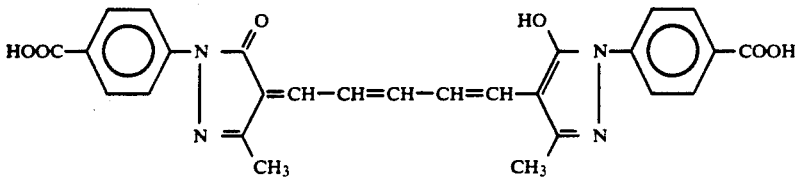
III-4
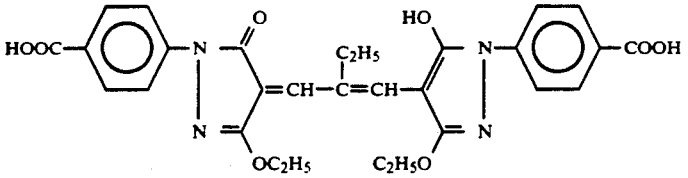
III-5
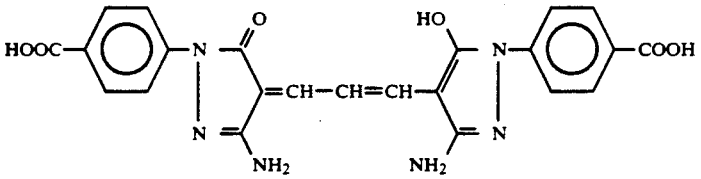
III-6
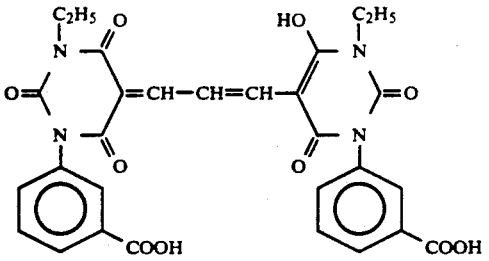
III-7
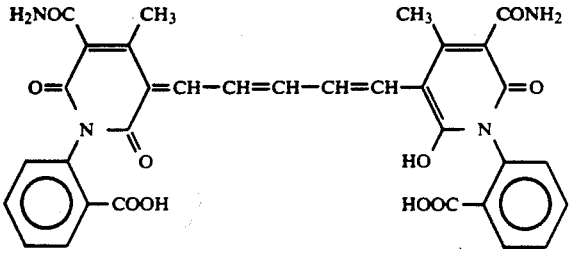

-continued
III-8
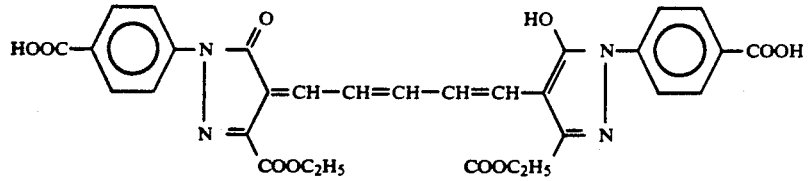
III-9
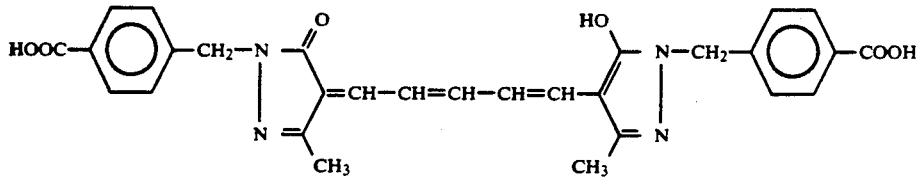
III-10
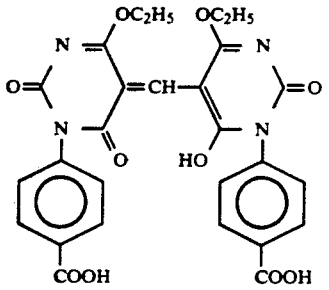
III-11
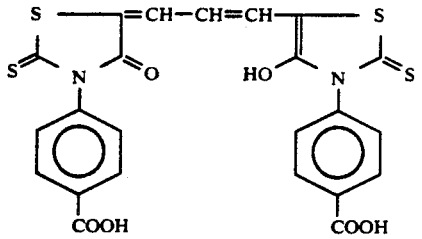
III-12
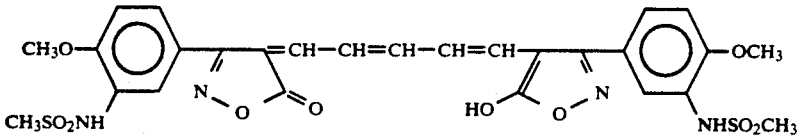
III-13
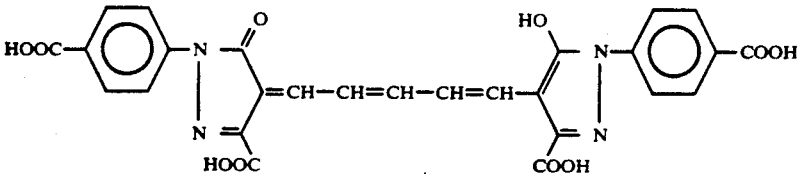
III-14
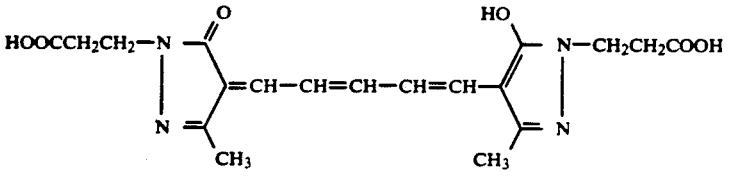
III-15
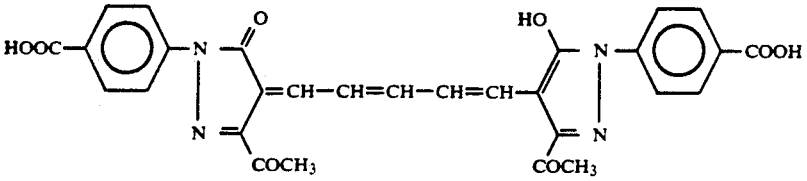

-continued
III-16
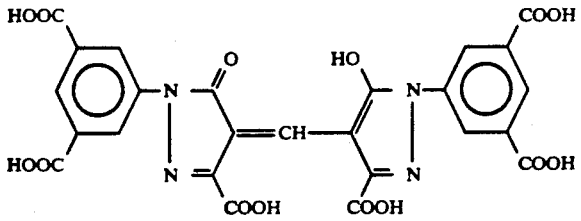
III-17
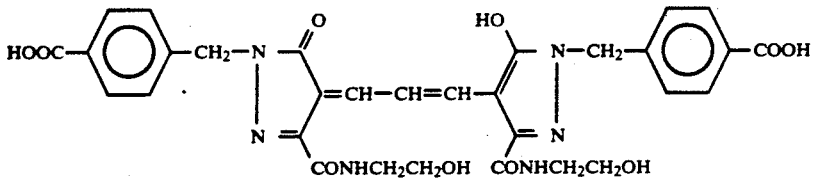
III-18
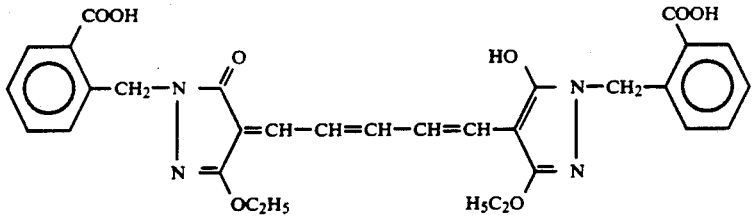
III-19
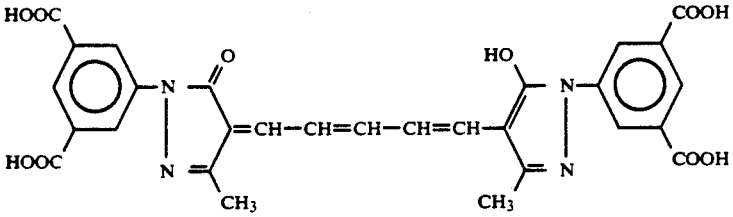
III-20
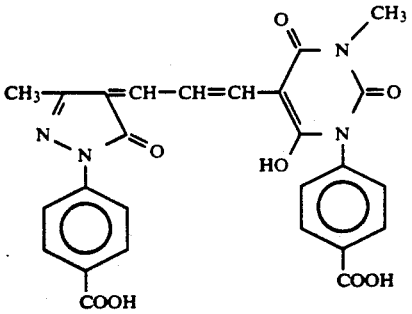
III-21
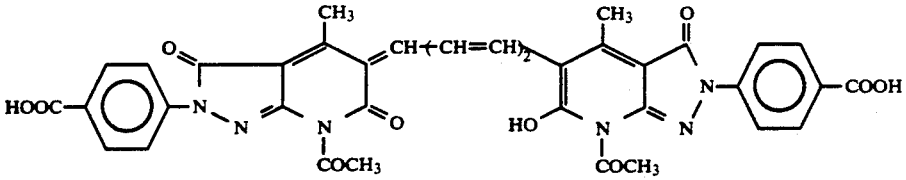
IV-1
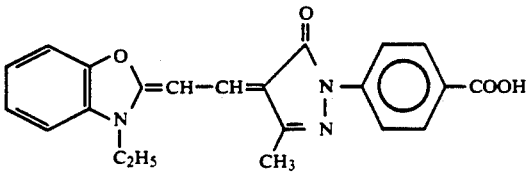

-continued
IV-2
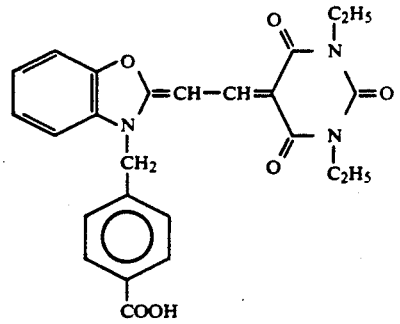
IV-3
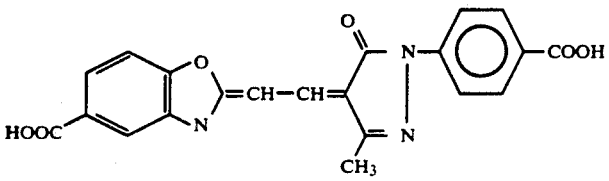
IV-4
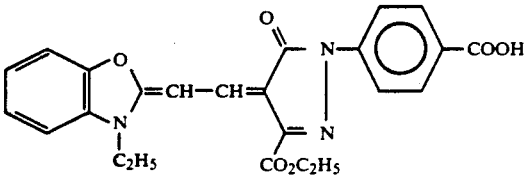
IV-5
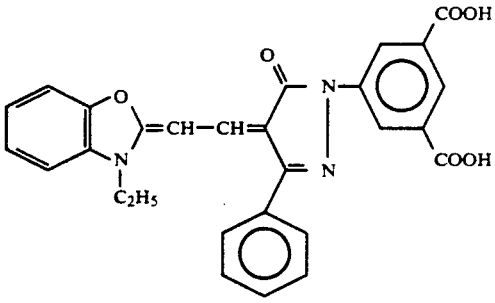
IV-6
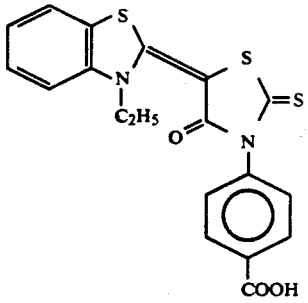
IV-7
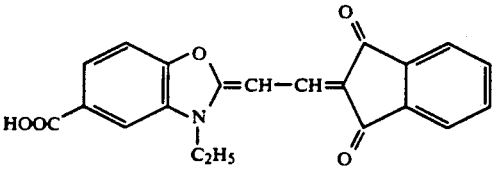

-continued

IV-8

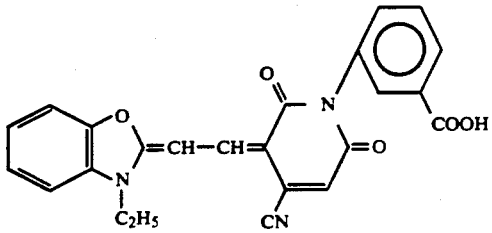

V-1

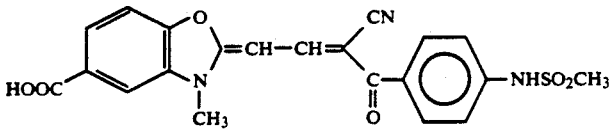

V-2

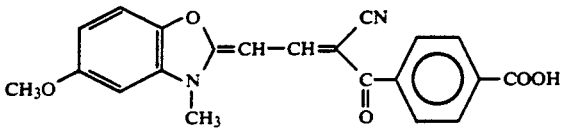

V-3

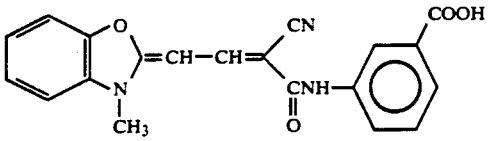

The dye which are used in the present invention can be easily synthesized according to the methods described in WO 88/04794, European Patents 0274723Al, 276,566 and 299,435, JP-A-52-92716 (the term JP-A" as used herein means an "unexamined published Japanese patent application"), JP-A-55-155350, JP-A-55-155351, JP-A-61-205934, JP-A-48-68623, and U.S. Pat. Nos. 2,527,583, 3,486,897, 3,746,539, 3,933,798, 4,130,429 and 4,040,841.

The dyes useful in the present invention can be used in a sufficient amount to filter or absorb light. It is particularly advantageous that the dyes are used in such an amount and at such a stage that they are solubilized during development and washed out. Only small amounts of the dyes are used when a small amount of light is to be absorbed, while when a larger amount of light is to be absorbed, larger amounts of the dyes can be used, so long as the colored level is left behind on a level which can be accepted by specific photographic elements. It is preferred that the dyes exist in an amount of 1 to 1000 mg/ft$^2$.

Any of conventional methods and processing solutions used for black-and-white photographic processing as described in, for example *Research Disclosure,* No. 176 (pages 28 to 30) (RD-17643) can be applied to the photographic processing of the photographic materials of the present invention. Processing temperature is generally in the range of 18 to 50° C. If desired, a temperature lower than 18° C. or higher than 50° C. may be used. However, processing at a temperature of 20° to 40° C. with an automatic processor is preferred in the present invention. Processing time (time taken until the dried photographic materials are discharged after the introduction thereof into the processor) is preferably in the range of 20 seconds to 5 minutes. Processing time in the range of 45 seconds to 3.5 minutes is particularly preferred.

Developing solutions used for black-and-white photographic processing may contain conventional developing agents. Examples of the developing agents include dihydroxybenzenes (e.g., hydroquinone), 3-pyrazolidones (e.g., 1-phenyl-3-pyrazolidone) and aminophenols (e.g., N methyl-p-aminophenol). These compounds may be used either alone or in combination. Generally, the developing solutions contain a conventional preservative, alkaline agent, pH buffering agent and anti-foggant. If desired, the developing solutions may contain a dissolution aid, color toning agent, development accelerator (e.g., quaternary salt, hydrazine, benzyl alcohol), development inhibitor (e.g., iodide, bromide, mercapto compound, triazole), surfactant, defoaming agent, water softener, hardening agent (e.g., glutaraldehyde) and viscosity increasing agent.

As a specific embodiment of development, there may be used a method wherein the developing agent is incorporated in the photographic material, for example, in emulsion layers, and the photographic material is processed in an aqueous alkaline solution to carry out development. Among the developing agents, hydrophobic agents can be incorporated in the emulsion layers by various methods described in *Research Disclosure,* No. 169 (RD-16928), U.S. Pat. No. 2,739,890, U.K. Patent 813,253 or West German Patent 1,547,763. Such development may be carried out in combination with a silver salt-stabilizing treatment using thiocyanates.

Fixing solutions having compositions conventionally used can be used in the present invention. Examples of fixing agents include thiosulfates and thiocyanates. In addition thereto, there can be used organosulfur compounds known as compounds having an effect as fixing agents. The fixing solutions may contain water-soluble aluminum salts as a hardening agent.

When compounds releasing inhibitors during development as described in JP-A-61-230135 and JP-A-63-25653 are used, effects obtained by the present invention can be enhanced.

Any of silver chlorobromide, silver bromide, silver iodobromide and silver chloroiodobromide can be used as the silver halide for use in the light-sensitive silver halide emulsions of the present invention. Silver iodobromide is preferred. The content of silver iodide is preferably not higher than 30 mol%, particularly preferably not higher than 10 mol%. The distribution of iodine in silver iodobromide grains may be uniform or different between the interior and the surface of grain. The mean grain size is preferably not smaller than 0.4 μm, particularly preferably 0.5 to 2.0 μm. Grain size distribution may be narrow or wide.

The silver halide grains of the present invention may have a regular crystal form such as a cube, octahedron, tetradecahedron or rhombic dodecahedron, an irregular crystal form such as a sphere, tabular or potato form or a composite form of these crystal forms. A mixture of grains having various crystal forms may be used. Tabular grains having a grain diameter at least 5 times the thickness of grain can be preferably used in the present invention, details of which are described in *Research Disclosure,* Vol. 225, item 22534, pp 20-58, January 1983, JP-A-58-127921 and JP-A-58-113926.

The light-sensitive silver halide emulsion of the present invention may be composed of a mixture of two or more silver halide emulsions. The emulsions to be mixed with each other may be different in grain size, halogen composition, sensitivity, etc. from each other. The sensitive emulsion may be used in admixture with a substantially non-sensitive emulsion (surface of interior may be fogged or not fogged). Alternatively, the sensitive layer and the non-sensitive layer may be separately used, details of which are described in U.S. Pat. Nos. 2,996,382 and 3,397,987. For example, a spherical or potato-form sensitive emulsion and a sensitive silver halide emulsion composed of tabular grains having a grain diameter at least 5 times the thickness of grain may be used in the same layer or different layers as described in JP-A-58-127921. When they are used in different layers, the sensitive silver halide emulsion composed of tabular grains may be positioned nearer to a support or may be away farther from the support than the other emulsion.

The photographic emulsions of the present invention can be prepared according to the methods described in P. Glafkides, *Chimie et Physique Photographique* (Paul Montel, 1967), G. F. Dufffin, *Photographic Emulsion Chemistry* (The Focal Press, 1966), V. L. Zelikman et al., *Making and Coating Photographic Emulsion* (The Focal Press, 1964), JP-A-58-127921 and JP-A-58-113926. Namely, any of the acid process, neutral process and ammonia process can be used. A soluble silver salt and a soluble halogen salt can be reacted in accordance with the single jet process, the double jet process or a combination thereof.

A reverse mixing method in which silver halide grains are formed in the presence of excess silver ion can be used. A controlled double jet process in which a pAg value in a liquid phase, wherein silver halide is formed, is kept constant can also be used. According to this process, there can be obtained a silver halide emulsion wherein the crystal form is regular and the grain size is nearly uniform.

The crystal structure of the silver halide grain may be uniform throughout the whole of the grain. The interior of the grain and the exterior thereof may be in different laminar structures from each other. The crystal structure may be a conversion type as described in U.K. Patent 635,841 and U.S. Pat. No. 3,622,318. Cadmium salt, zinc salt, lead salt, thallium salt, iridium salt or complex salt thereof, rhodium salt or complex salt thereof, or iron salt or complex salt thereof may be allowed to coexist during the formation of silver halide grains in the production of silver halide grains or during physical ripening.

Solvents for silver halide, such as ammonia, thioether compounds, thiazolidine-2-thione, tetra-substituted thioureas, potassium thiocyanate, ammonium thiocyanate and amine compounds may be allowed to exist during the formation of grains to control the growth of grains.

The silver halide emulsions of the present invention may or may not be subjected to chemical sensitization. Examples of chemical sensitization include conventional sulfur sensitization, reduction sensitization and gold sensitization. These sensitization methods may be used either alone or in combination.

Among noble metal sensitization methods, gold sensitization is a typical method. Gold compounds, particularly gold complexes, are used. In addition to gold complexes, complex salts of other noble metals such as platinum, palladium and iridium may be used. Examples thereof are described in U.S. Pat. No. 2,448,060 and U.K. Patent 618,061.

Examples of sulfur sensitizing agents include sulfur compounds contained in gelatin. In addition thereto, various sulfur compounds such as thiosulfates, thioureas, thiazoles and rhodanines can be used as sulfur sensitizing agents.

Examples of reduction sensitizing agents include stannous salts, amines, formamidinesulfinic acid and silane compounds.

The photographic emulsions of the present invention may contain various compounds to prevent fogging during the production, storage or processing of the photographic materials from being caused or to stabilize photographic performance. Examples of the compounds which are known as antifoggants or stabilizers include azoles (e.g., benzthiazolium salts, nitroimidazoles, nitrobenzimidazoles, chlorobenzimidazoles, bromobenzimidazoles, nitroindazoles, benztriazoles, aminotriazoles); mercapto compounds (e.g., mercaptothiazoles, mercaptobenzthiazoles, mercaptobenzimidazoles, mercaptothiadiazoles, mercaptotetrazoles (particularly 1-phenyl-5-mercaptotetrazoles), mercaptopyrimidines, mercaptotriazines); thio-keto compounds such as oxazolinethione; azaindenes (e.g., triazaindenes, tetraazaindenes (particularly, 4-hydroxy-substituted (1,3,3a,7)-tetraazaindenes), pentaazaindenes)); and benzenethiosulfonic acid, benzenesulfinic acid and benzenesulfonamide.

Particularly preferred examples of the compounds are nitron and derivatives described in JP-A-60-76743 and JP-A-60-87322; mercapto compounds described in JP-A-60-80839; and heterocyclic compounds and complex salts of heterocyclic compounds with silver (e.g., 1-phenyl-5-mercaptotetrazolesilver).

The sensitive silver halide emulsions of the present invention may be spectrally sensitized to relatively long wave blue light, green light, red light or infrared light by using spectral sensitizing agents. Examples of the sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

The sensitizing agents may be added at any stage during the course of the manufacturing process of the photographic emulsions or at any stage immediately before coating after the production of the emulsions. In the former case, the agents are added during the formation of silver halide grains, physical ripening or chemical ripening.

The photographic emulsion layers or other hydrophilic colloid layers of the photographic materials of the present invention may contain various surfactants as coating aid or for the purpose of imparting antistatic properties, improving slipperiness, emulsion dispersion and photographic characteristics (e.g., development acceleration, high contrast, sensitization) or preventing the occurrence of sticking.

Examples of the surfactants include nonionic surfactants such as saponin (steroid), alkylene oxide derivatives (e.g., polyethylene glycol, polyethylene glycol/polypropylene glycol condensate, polyethylene glycol alkyl ethers, polyethylene alkyl aryl ethers, polyethylene oxide adducts of silicone) and alkyl esters of saccharide; anionic surfactants such as alkylsulfonates, alkylbenzenesulfonate, alkylnaphthalenesulfonates, alkylsulfuric esters, N-acyl-N-alkyltaurines, sulfosuccinic esters and sulfoalkylpolyoxyethylene alkylphenyl ethers; ampholytic surfactants such as alkylbetaines and alkylsulfobetaines; and cationic surfactants such as aliphatic or aromatic quaternary ammonium salts, pyridinium salts and imidazolium salts. Among them, particularly preferred are saponin, anions such as Na salt of dodecylbenzenesulfonic acid, Na salt of di-2-ethylhexyl α-sulfosuccinate, Na salt of p-octylphenoxyethoxyethoxyethanesulfonic acid, Na salt of dodecylsulfuric acid, Na salt of triisopropylnaphthalenesulfonic acid and Na salt of N-methyl-oleoyltaurine; cations such as dodecyltrimethylammonium chloride, N-oleoyl-N',N',N'-trimethylammoniodiaminopropane bromide and dodecylpyridium chloride; betaines such as N-dodecyl-N,N-dimethylcarboxybetaine and N-oleyl-N,N-dimethylsulfobutylbetaine; and nonions such as poly(average polymerization degree (n=10))oxyethylene cetyl ether, poly(n=25)oxyethylene p-nonylphenol ether and bis(1-poly(N=15)oxyethylene-oxy-2,4-di-pentylphenyl)ethane.

As antistatic agents, there are preferred fluorine-containing surfactants such as K salt of perfluorooctanesulfonic acid, Na salt of N-propyl-N-perfluorooctane sulfonylglycine, Na salt of N-propyl-N-perfluorooctanesulfonylaminoethyloxypoly(n=3)oxyethylene butanesulfonic acid, N-perfluorooctanesulfonyl-N',N',N'-trimethylammoniodiaminopropane chloride and N-perfluorodecanoylaminopropyl-N',N'-dimethyl-N'-carboxybetaine, nonionic surfactants described in JP-A-60-80848, JP-A-61-112144, JP-A-62-172343 and JP-A-62-173459, alkali metal nitrates, electrically conductive tin oxide, zinc oxide, vanadium pentoxide and their composite oxides doped with antimony, etc.

Examples of matting agents which can be used in the present invention include organic compounds such as homopolymers (e.g., polymethyl methacrylate), copolymers (e.g., copolymer of methyl methacrylate with methacrylic acid) and starch and fine particles of inorganic compounds such as silica and titanium dioxide. The particle size thereof is preferably 1.0 to 10 μm, particularly preferably 2 to 5 μm.

The surface layers of the photographic materials of the present invention may contain slip agents such as silicone compounds described in U.S. Pat. Nos. 3,489,576 and 4,047,958, colloidal silica described in JP-B-56-23139 (the term "JP-B" as used herein means an "examined Japanese patent publication"), paraffin wax, higher fatty acid esters and starch derivatives.

The hydrophilic colloid layers of the photographic materials of the present invention may contain, as plasticizers, polyols such as trimethylol propane, pentanediol, butanediol, ethylene glycol and glycerine. Further, it is preferred that polymer latex is incorporated in the hydrophilic colloid layers of the photographic materials of the present invention to improve pressure resistance. Preferred examples of polymers include homopolymers of alkyl acrylates, copolymers of alkyl acrylates with acrylic acid, styrene/butadiene copolymer and polymers or copolymers of monomers having active methylene group.

The photographic emulsion layers and non-sensitive hydrophilic colloid layers of the present invention may contain inorganic or organic hardening agents. Preferred examples of the hardening agents include chromium salts, aldehydes (e.g., formaldehyde, glutaraldehyde), N-methylol compounds (e.g., dimethylol urea), active vinyl compounds (e.g., 1,3,5-triacryloylhexahydro-s-triazine, bis(vinylsulfonyl)methyl ether, N,N'-methylenebis[8-(vinylsulfonyl)propionamide], active halogen compounds (e.g., 2,4-dichloro-6-hydroxy-s-triazine), mucohalogen acids (e.g., mucochloric acid), N-carbamoylpyridinium salts (e.g., (1-morpholinocarbonyl-3-pyridinio)methanesulfonate) and halo amidinium salts (e.g., (1-(1-chloro-1-pyridinomethylene)pyrrolidinium, 2-naphthalenesulfonate). These compounds may be used either alone or in combination. Among them, there are preferred active vinyl compounds described in JP-A-53-41220, JP-A-53-57257, JP-A-59-162546 and JP-A-60-80846 and active halogen compounds described in U.S. Pat. No. 3,325,287.

When the photographic materials of the present invention are used as X-ray photographic materials, it is preferred that the hydrophilic colloid layers are hardened with these hardening agents to such an extent as to give a swelling ratio of not higher than 200%, particularly not higher than 150% in water.

Gelatin is advantageously used as a binder or protective colloid for use in the emulsion layers or interlayers of the photographic materials of the present invention. However, other hydrophilic colloid can be used. For example, synthetic hydrophilic high-molecular materials such as dextran, polyvinyl alcohol, polyvinyl alcohol partial acetal, poly-N-vinylpyrrolidone, polyacrylic acid, polyacrylamide and polyvinylimidazole and copolymers thereof can be used.

Examples of gelatin include lime-processed gelatin, acid-processed gelatin and enzyme-processed gelatin. Hydrolyzate of gelatin can also be used.

It is preferred to use gelatin together with dextran and polyacrylamide.

Development can be carried out by referring to the above-described *Research Disclosure.*

The present invention is now illustrated in greater detail by reference to the following examples which, however, are not to be construed as limiting the invention in any way.

EXAMPLE 1

A biaxially oriented polyethylene terephthalate film of 175 μm in thickness was subjected to corona discharge treatment and was coated with the following first undercoating solution having the following composition by means of a wire bar coater in such an amount as to give a coating weight of 5.1 cc/m2. The coated film was dried at 175° C. for one minute. In the same way as in the above coating, the other side was coated with the first undercoating solution to form a first undercoat layer.

| | |
|---|---|
| Butadiene-styrene copolymer latex solution (solid: 40%, butadiene/styrene = 31/69 by weight)* | 79 cc |
| 4% solution of sodium salt of 2,4-dichloro-6-hydroxy-s-triazine | 20.5 cc |
| Distilled water | 900.5 cc |

*The latex solution contained 0.4 wt % (based on the amount, on a solid basis, of latex) of the following compound as an emulsifying dispersant.

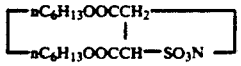

Both sides of the film having the first undercoat were coated with the following second undercoating solution having the following composition in such an amount as to give a coating weight of 8.5 cc/m2 on each side. The coated product (both sides being coated) was dried to obtain an undercoated film.

| | |
|---|---|
| Gelatin | 20 g |
| Fine particles of the invention indicated in Table 2. | |
| Dye indicated in Table 2. | |
| 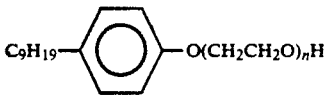 (n = 8.5) | 0.2 g |
| Matting agent (polymethyl methacrylate having an average particle size of 2.5 μm) | 0.3 g |
| 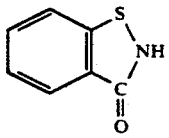 | 0.035 g |
| $H_2O$ | to make 1 liter |

Preparation of Coating Solution for Emulsion Layer 5 g of potassium bromide, 0.05 g of potassium iodide, 30 g of gelatin and 2.5 cc of a 5% aqueous solution of thioether $HO(CH_2)_2S(CH_2)_2S(CH_2)_2OH$ were added to 1 liter of water. To the resulting solution kept at 73° C. with stirring, there were added an aqueous solution of 8.33 g of silver nitrate and an aqueous solution containing 5.94 g of potassium bromide and 0.726 g of potassium iodide over a period of 45 seconds by double jet process. Subsequently, 2.5 g of potassium bromide was added thereto. Further, an aqueous solution containing 8.33 g of silver nitrate was added thereto over a period of 7.5 minutes at such a rate that the flow rate at the time of the completion of the addition was twice that at the time of the commencement of the addition. Subsequently, an aqueous solution of 153.34 g of silver nitrate and an aqueous solution of a mixture of potassium bromide and potassium iodide were added thereto over a period of 25 minutes by controlled double jet process while keeping potential at a pAg of 8.1. The addition was made at such an accelerating rate that the flow rate at the time of the completion of the addition was 8 times that at the time of the commencement of the addition. After the completion of the addition, 15 cc of 2N potassium thiocyanate solution was added thereto. Further, 50 cc of a 1% aqueous solution of potassium iodide was added thereto over a period of 30 seconds. The temperature of the mixture was lowered to 35° C. and soluble salts were removed by precipitation method. The temperature was raised to 40° C. 6 g of gelatin, 2 g of phenol and 7.5 g of trimethylol propane were added thereto. The pH of the mixture was adjusted to 6.55 and pAg was adjusted to 8.10 by using caustic soda and potassium bromide.

After the temperature was raised to 56° C, 175 mg of 4-hydroxy-6-methyl-1,3,3a,7-tetraazaindene and 625 mg of the following sensitizing dye were added thereto. After 10 minutes, 5.5 mg of sodium thiosulfate pentahydrate, 163 mg of potassium thiocyanate and 3.6 mg of chloroauric acid were added thereto. After 5 minutes, the mixture was quenched to solidify it. The resulting emulsion was composed of grains having such a grain-size distribution that grains having an aspect ratio of not lower than 3 accounted for 93% of the sum total of the projected area of the entire grains. With regard to all grains having an aspect ratio of not lower than 2, the average diameter of projected areas was 0.95 μm, standard deviation was 23%, average thickness was 0.155 μm and aspect ratio was 6.1.

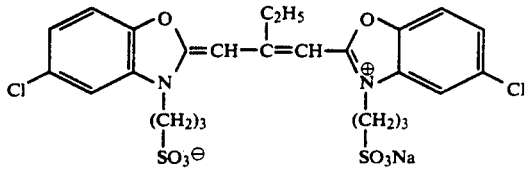

The following reagents were added to the emulsion to prepare a coating solution, each amount being per mol of silver halide.

| | |
|---|---|
| 2,6-Bis(hydroxyamino)-4-diethylamino-1,3,5-triazine | 80 mg |
| Sodium polyacrylate (average molecular weight: 41,000) | 4.0 g |
| 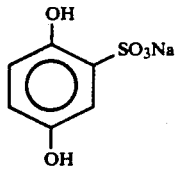 | 9.7 g |
| Ethyl acrylate/acrylic acid/methacrylic acid (95/2/3) copolymer plasticizer | 20.0 g |
| Nitron | 50 mg |
| 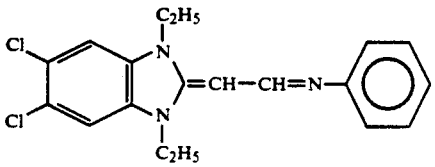 | 5.0 mg |

Both sides of the support prepared as described above were coated with the thus-prepared coating solution for emulsion layer and a coating solution for surface protective layer in the same manner by means of a co-extrusion method. The coating weights of the emulsion layer and the surface protective layer per one side were the following amounts.

| | |
|---|---|
| Emulsion Layer | |
| Coated silver amount | 1.9 g/m$^2$ |
| Coated gelatin amount | 1.5 g/m$^2$ |
| Surface Protective Layer | |
| Gelatin | 0.81 g/m$^2$ |
| Dextran (average molecular weight: 39,000) | 0.81 g/m$^2$ |
| Matting agent (polymethyl methacrylate/methacrylic acid (9/1) copolymer, average particle size: 3.5 μm) | 0.06 g/m$^2$ |
| 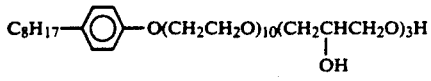 | 60 mg/m$^2$ |
| 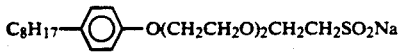 | 20 mg/m$^2$ |
| $C_8F_{17}SO_2N(C_3H_7)(CH_2CH_2O)_4(CH_2)_4SO_3Na$ | 2 mg/m$^2$ |
| $C_8F_{17}SO_2N(C_3H_7)(CH_2CH_2O)_{15}H$ | 5 mg/m$^2$ |
| 4-Hydroxy-6-methyl-1,3,3a,7-tetraazaindene | 15.5 mg/m$^2$ |
| Sodium polyacrylate (average molecular weight: 41,000) | 70 mg/m$^2$ |

1,2-Bis(sulfonylacetamido)ethane as hardening agent was coated in such an amount as to give a coating weight of 56 mg/m$^2$ per one side. In this way, the photographic material of the present invention was prepared.

Evaluation of Photographic Performance

GRENEX ortho-screen HR-4 (manufactured by Fuji Photo Film Co., Ltd.) was brought into close contact with both sides of the photographic material by using a cassette. X-ray sensitometry was carried out. The adjustment of exposure amount was made by changing the distance between the X-ray tube and the cassette. After exposure, the photographic material was processed by using the following developing solution and fixing solution in an automatic processor.

Measurement of Sharpness (MTF)

MTF was measured by combining the above-described HR-4 screen with processing by an automatic processor. Measurement was made by an aperture of 30 μm ×500 μm. Evaluation was made at an optical density of 1.0 by using MTF value at a spatial frequency of 1.0 cycle/mm.

Measurement of Residual Color

Unexposed film was subjected to the above-described processing in an automatic processor. Subsequently, green-transmitted density was measured through Macbeth status A filter. The green-transmitted density of non-undercoated blue polyethylene terephthalate support was measured. A net value obtained by making substraction was referred to as residual color density value. Evaluation was made on the basis of the value.

Evaluation of Crossover

GRENEX ortho-screen HR-4 (manufactured by Fuji Photo Film Co., Ltd.) was brought into close contact with one side of the sample by using a cassette. X-ray sensitometry was carried out. The sample was processed in the same way as in the evaluation of photographic performance. The value of crossover was calculated from the following formula by using a difference in sensitivity (log E) between the surface (front surface) contacted with the screen and other surface (back surface).

$$\% = \frac{1}{\text{anti log}\,(\Delta\log E) + 1} \times 100$$

Evaluation of Surface Profile

The surface profile of the sample was confirmed by using a loupe (ten times magnification).

○: No problem.

x: Three or more agglomerates per m$^2$ were observed.

| | |
|---|---|
| Development | 35° C. × 9.5 sec |
| Fixing | 31° C. × 10 sec |
| Rinse | 15° C. × 6 sec |
| Squeeze | 6 sec |
| Drying | 50° C. × 12 sec |
| Dry to Dry processing time | 45 sec |

The developing solution and fixing solution had the following composition.

| | |
|---|---|
| Developing Solution | |
| Potassium hydroxide | 29 g |
| Potassium sulfite | 44.2 g |
| Sodium hydrogencarbonate | 7.5 g |
| Boric acid | 1.0 g |
| Diethylene glycol | 12 g |
| Ethylenediaminetetraacetic acid | 1.7 g |
| 5-Methylbenztriazole | 0.06 g |
| Hydroquinone | 25 g |
| Glacial acetic acid | 18 g |
| Triethylene glycol | 12 g |
| 5-Nitroindazole | 0.25 g |
| 1-Phenyl-3-pyrazolidone | 2.8 g |
| Glutaraldehyde (50 wt/wt %) | 9.86 g |
| Sodium metabisulfite | 12.6 g |
| Potassium bromide | 3.7 g |
| Water to make | 1.0 liter |
| Fixing Solution | |
| Ammonium thiosulfate (70 wt/vol %) | 200 ml |
| Disodium ethylenediaminetetraacetate dihydrate | 0.02 g |
| Sodium sulfite | 15 g |
| Boric acid | 10 g |
| Sodium hydroxide | 6.7 g |
| Glacial acetic acid | 15 g |
| Aluminum sulfate | 10 g |
| Sulfuric acid (36N) | 3.9 g |
| Water to make | 1.0 liter |
| pH was adjusted to | 4.25 |

TABLE 2

| Sample | Fine Particle of Invention ($mg/m^2$) | Dye ($mg/m^2$) | Surface Profile | Crossover (%) | MTF | Residual Color |
|---|---|---|---|---|---|---|
| 1 (Comp. Ex.) | — | — | ○ | 30 | 0.42 | 0.02 |
| 2 (Comp. Ex.) | Colloidal silica (670) | — | ○ | 30 | 0.42 | 0.02 |
| 3 (Invention) | Colloidal silica (420) | I-1 (250) | ○ | 9 | 0.57 | 0.02 |
| 4 (Invention) | Colloidal silica (670) | I-1 (400) | ○ | 2 | 0.59 | 0.02 |
| 5 (Comp. Ex.) | — | I-1 (250) | X | 19 | 0.50 | 0.03 |
| 6 (Comp. Ex.) | — | I-1 (400) | X | 10 | 0.56 | 0.04 |
| 7 (Comp. Ex.) | — | I-1 (250) | X | 10 | 0.56 | 0.02 |
| 8 (Comp. Ex.) | — | I-1 (400) | X | 3 | 0.59 | 0.02 |

Samples 3 and 4 were prepared using a second undercoating solution prepared in such a manner that dye I-1 was previously dissolved in an alkaline solution having a pH of 10, an aqueous dispersion of colloidal silica (average size: 0.02 μ) was slowly added to the resulting solution which was stirred and the mixture was neutralized with HCl (IN) and then added to gelatin.

Samples 5 and 6 were prepared in the same manner as in the preparation of Samples 3 and 4 except that water containing no colloidal silica was used.

Samples 7 and 8 were prepared using a second undercoating solution containing the solid disperse dye (average size: 0.8 μ) dispersed in a ball mill for 6 hours.

It is apparent from Table 2 that even when the amounts of the dyes are the same, the samples of the present invention have a remarkable effect of reducing crossover, do not cause surface damage and leave residual color on a level of the case where no dye is added.

While the invention has been described in detail and with reference to specific embodiments thereof, it is apparent to one skilled in the art that various changes and modifications can be made therein without departing from the spirit and scope thereof.

What is claimed is:

1. An X-ray photographic material comprising a transparent support having at least one photosensitive silver halide emulsion layer provided on each side of said support and having at least one layer containing a dye which absorbs light in the sensitive region of said sensitive silver halide photographic emulsion layer provided between said light-sensitive emulsion layer and the support, wherein:

(a) crossover is less than 10%;

(b) said dye is adsorbed onto fine particles which fine particles provide surfaces onto which the dye can be adsorbed;

(c) said dye can be decolorized or washed out during development; and (d) said dye is a compound selected from the group consisting of compounds represented by the following formula (I) to (V)

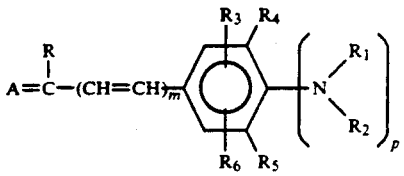

(I)

-continued

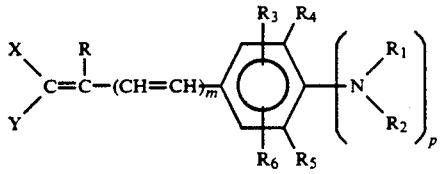

(II)

$$A{=}L_1{\rightleftharpoons}L_2{=}L_3{\rightleftharpoons}_n A' \quad \text{(III)}$$

$$A{\rightleftharpoons}L_1{-}L_2{\rightleftharpoons}_{2-m} B \quad \text{(IV)}$$

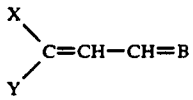

(V)

wherein A and A' may be the same or different groups and each represents a substituted or unsubstituted acid nucleus having a carboxyphenyl group, a sulfamoylphenyl group, a sulfonamidophenyl group, a carboxyalkyl group or hydroxyphenyl group, said acid nucleus being selected from the group consisting of 2-pyrazoline-5-one, rhodanine, hydantoin, thiohydantoin, 2,4-oxazolidinedione, isoxazolidinone, barbituric acid, thiobarbituric acid, indanedione, pyrazolopyridine and hydroxypyridone; B represents a substituted or unsubstituted basic nucleus having carboyl group, sulfamoyl group or sulfonamido group, said basic nucleus being selected from the group consisting of pyridine, quinoline, indolenine, oxazole, benzoxazole, naphthoxazole and pyrrole; R represents a hydrogen atom or an alkyl group; $R_1$ and $R_2$ each represents a substituted or unsubstituted alkyl group, a substituted or unsubstituted aryl group, an acyl group or a sulfonyl group, or $R_1$ and $R_2$ may be combined together to form a 5-membered or 6-membered ring; $R_3$ and $R_6$ each represents a hydrogen atom, a hydroxyl group, a carboxyl group, an alkyl group, an alkoxy group or a halogen atom; $R_4$ and $R_5$ each represents a hydrogen atom or a non-metallic atomic group required for the formation of a 5-membered or 6-membered ring when $R_1$ and $R_4$ or $R_2$ and $R_5$ are combined together; $L_1$, $L_2$ and $L_3$ each represents a substituted or unsubstituted methine group; X and Y each represents an electron attractive group and one of X and Y has at least one carboxyphenyl, sulfamoylphenyl, sulfonamidophenyl, carboxyalkyl or hydroxyphenyl group; m represents 0 or 1; n represents 1, 1 or 2; and p represents 0 or 1 with the proviso that when p is 0, $R_3$ is a hydroxy group or a carboxyl group and $R_4$ and $R_5$ each is a hydrogen atom, wherein said fine particles are colloidal silica.

2. An X-ray photographic material as in claim 1, wherein said fine particles are in the range of from 0.001 to 2.0 μm.

3. An X-ray photographic material as in claim 1, wherein said fine particles are in the range of from 0.005 to 1.0 μm.

4. An X-ray photographic material as in claim 1, wherein said fine particles are in the range of from 0.005 to 0.5 μm.

5. An X-ray photographic material as in claim 1, wherein the fine particles are present in an amount of from 10 mg/m$^2$ to 10 g/m$^2$.

6. An X-ray photographic material as in claim 1, wherein the fine particles are present in an amount of from 50 mg/m$_2$ to 1 g/m$_2$.

7. An X-ray photographic material as in claim 1, wherein the carboxy alkyl group attached to the acid nuclei represented by A and A' and the electron attractive group represented by X or Y has from 1 to 10 carbon atoms.

8. An X-ray photographic material as in claim 1, wherein the alkyl groups represented by R, $R_3$ and $R_6$ have from 1 to 10 carbon atoms.

9. An X-ray photographic material as in claim 1, wherein the alkyl groups represented by $R_1$ and $R_2$ having from 1 to 20 carbon atoms and the acyl groups represented by $R_1$ and $R_2$ have from 2 to 10 carbon atoms.

10. An X-ray photographic material as in claim 1, wherein the alkoxy group represented by $R_2$ and $R_6$ has from 1 to 10 carbon atoms.

11. A method for forming an image comprising:

(a) imagewise exposing a photographic material comprising a transparent support having at least one photosensitive silver halide emulsion layer provided on each side of said support and having at least one layer containing a dye which absorbs light in the sensitive region of said sensitive silver halide photographic emulsion layer provided between said light sensitive emulsion layers, wherein crossover is less than 10%, said dye is adsorbed onto fine particles which fine particles provide surfaces onto which the dye can be adsorbed, said dye can be decolorized or washed out during development, and said dye is a compound selected from the group consisting of compounds represented by the following formulae (I) to (V)

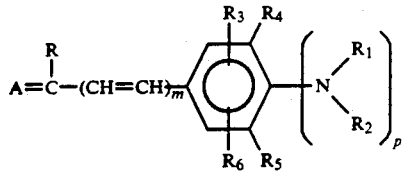

(I)

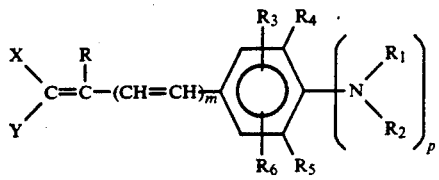

(II)

$$A{=}L_1{\leftarrow}L_2{=}L_3{\rightarrow}_n A' \quad \text{(III)}$$

$$A{\rightleftharpoons}L_1{-}L_2{\rightarrow}_{2-m}B \quad \text{(IV)}$$

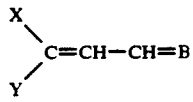

(V)

wherein A and A' may be the same or different groups and each represents a substituted or unsubstituted acid nucleus having a carboxyphenyl group, a sulfamoylphenyl group, a sulfonamidophenyl group, a carboxyalkyl group or hydroxyphenyl group, said acid nucleus being selected from the group consisting of 2-pyrazoline-5-one, rhodanine, hydantoin, 2,4-oxazolidinedione, isoxazolidinone, barbituric acid, thiobarbituric acid, indanedione, pyrazolopyridine and hydroxypyridone; B represents a substituted or unsubstituted basic nucleus having carboxyl group, sulfamoyl group or sulfonamido group, said basic nucleus being selected from the group consisting of pyridine, quinoline, indolenine, oxazole, benzoxazole, naphthoxazole and pyrrole; R represents hydrogen atom or an alkyl group; $R_1$ and $R_2$ each represents a substituted or unsubstituted alkyl group, a substituted or unsubstituted aryl group, an acyl group or a sulfonyl group, or $R_1$ and $R_2$ may be combined together to form a 5-membered or 6-membered ring; $R_3$ and $R_6$ each represents a hydrogen atom, a hydroxyl group, a carboxyl group, an alkyl group, an alkoxy group or a halogen atom; $R_4$ and $R_5$ each represents a hydrogen atom or a non-metallic atomic group required for the formation of a 5-membered or 6-membered ring when $R_1$ and $R_4$ or $R_2$ and $R_5$ are combined together; $L_1$, $L_2$ $L_3$ each represents a substituted or unsubstituted methine group; X and Y each represents an electron attractive group and one of X and Y has at least one carboxyphenyl, sulfamoylphenyl, sulfonamidophenyl, carboxyalkyl or hydroxyphenyl group; m represents 0 or 1; n represents 0, 1 or 2; and p represents 0 or 1 with the proviso that when p is 0, $R_3$ is a hydroxy group or a carboxyl group and $R_4$ and $R_5$ each is a hydrogen atom; and (b) processing said photographic material, wherein the processing time is from 20 seconds to 90 seconds, and wherein said fine particles are selected from the group consisting of colloidal silica, colloidal alumina, and colloidal silica alumina.

* * * * *